US011365708B2

(12) United States Patent
Muramatsu et al.

(10) Patent No.: US 11,365,708 B2
(45) Date of Patent: Jun. 21, 2022

(54) FUEL SUPPLY DEVICE

(71) Applicant: DENSO CORPORATION, Kariya (JP)

(72) Inventors: Toshihiko Muramatsu, Kariya (JP); Yuuji Hirata, Kariya (JP); Yuto Sato, Kariya (JP); Keiji Suzuki, Koga (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/196,083

(22) Filed: Mar. 9, 2021

(65) Prior Publication Data

US 2021/0190021 A1 Jun. 24, 2021

Related U.S. Application Data

(63) Continuation of application No. PCT/JP2019/030870, filed on Aug. 6, 2019.

(30) Foreign Application Priority Data

Sep. 11, 2018 (JP) ..... JP2018-169455

(51) Int. Cl.
*F02M 37/02* (2006.01)
*F02M 37/10* (2006.01)

(52) U.S. Cl.
CPC ..... *F02M 37/103* (2013.01)

(58) Field of Classification Search
CPC ..... F02M 37/103; F02M 37/00
See application file for complete search history.

(56) References Cited

U.S. PATENT DOCUMENTS

2003/0188724 A1* 10/2003 Suzuki ..... F02M 37/44 123/509
2005/0087227 A1 4/2005 Powell et al.
2007/0084445 A1 4/2007 Pike et al.
2012/0063938 A1* 3/2012 Okazono ..... F02M 37/106 417/437
2017/0314522 A1* 11/2017 Takahashi ..... F02M 55/04
2017/0355261 A1* 12/2017 Niwa ..... H01R 12/77
2018/0313461 A1* 11/2018 Sugiyama ..... F16K 24/042
2019/0047405 A1* 2/2019 Niwa ..... B60K 15/03504
2019/0048836 A1* 2/2019 Suzuki ..... F02M 37/106
2019/0136810 A1* 5/2019 Niwa ..... F02M 37/50

FOREIGN PATENT DOCUMENTS

JP 2009-261221 11/2009
JP 2014-109255 6/2014
JP 2014109255 A * 6/2014

* cited by examiner

*Primary Examiner* — Sizo B Vilakazi
(74) *Attorney, Agent, or Firm* — Nixon & Vanderhye P.C.

(57) ABSTRACT

A fuel supply device, which is mounted on a fuel tank, includes a lid member that covers an opening of the fuel tank, arm members mounted on the lid member, and a component mounted on the lid member via the arm members. The arm members and the component have an engaging structure which engages each other by elastic deformation of the arm members. The arm members are made of a resin material having a higher elastic modulus than the resin material forming the lid member.

6 Claims, 18 Drawing Sheets

FUEL SUPPLY DEVICE

CROSS REFERENCE TO RELATED APPLICATIONS

The present application is a continuation application of International Patent Application No. PCT/JP2019/030870 filed on Aug. 6, 2019, which designated the U.S. and claims the benefit of priority from Japanese Patent Application No. 2018-169455 filed in Japan filed on Sep. 11, 2018, the entire disclosure of the above application is incorporated herein by reference.

TECHNICAL FIELD

A present disclosure relates to a fuel supply device.

BACKGROUND

In a fuel supply device, at least one component is mounted in or on a fuel tank. At least one component is fixed to a resin member of the fuel tank by using an elastic deformation of the resin member, e.g., using a snap-fit structure. It is required to keep a stable fixing condition of the component. In the above aspects, or in other aspects not mentioned, there is a need for further improvements in a fuel supply device.

SUMMARY

The present disclosure may be provided by the following embodiments. According to one aspect of the present disclosure, a fuel supply device mounted on a fuel tank is provided. The fuel supply device includes a lid member that covers an opening of the fuel tank, an arm member that is mounted on the lid member, and a component that is mounted on the lid member via the arm member. The arm member and the component have an engaging structure which engages each other by elastic deformation of the arm member, and the arm member is made of a resin material having a higher elastic modulus than a resin material forming the lid member.

According to the present disclosure, it is possible to provide the fuel supply device having the engaging structure for engaging the arm member and the component by elastic deformation of the arm member, e.g., the snap-fit structure.

BRIEF DESCRIPTION OF DRAWINGS

The above and other objects, features and advantages of the present disclosure will become more apparent from the following detailed description made with reference to the accompanying drawings.

The disclosure is further described with reference to the accompanying drawings in which.

DETAILED DESCRIPTION

In some apparatus a fuel vapor valve, which is one of functional components of a fuel supply device, is mounted on a lower surface of a flange of a fuel pump module mounted on a fuel tank. This fuel vapor valve is detachably mounted on the flange by a snap-fit structure configured by mounting tabs of the fuel vapor valve and apertures of elastic leg members integrally formed with the flange.

However, since the flange covering an opening of the fuel tank may be deteriorated and even damaged by oxidization due to water, acidic deposits, etc., it is required to improve acid resistance property of the flange. A flange made by a method of injection molding using a resin material having acid resistance such as PPS (Polyphenylene sulfide) or PPA (Polyphthalamide) may improve acid resistance property. However, the resin material having acid resistance is likely to have extremely low elasticity and toughness. When mounting the fuel vapor valve to the flange, the leg member integrally formed with the flange may be too much deformed by the mounting tab and may receive too much stress at a portion. Then the leg member may be cracked or broken at a root portion. Therefore, it is difficult to use a resin material having acid resistance in the flange member integrally formed with a leg member which may be deformed as a snap-fit structure.

A. First Embodiment

Figure 1:
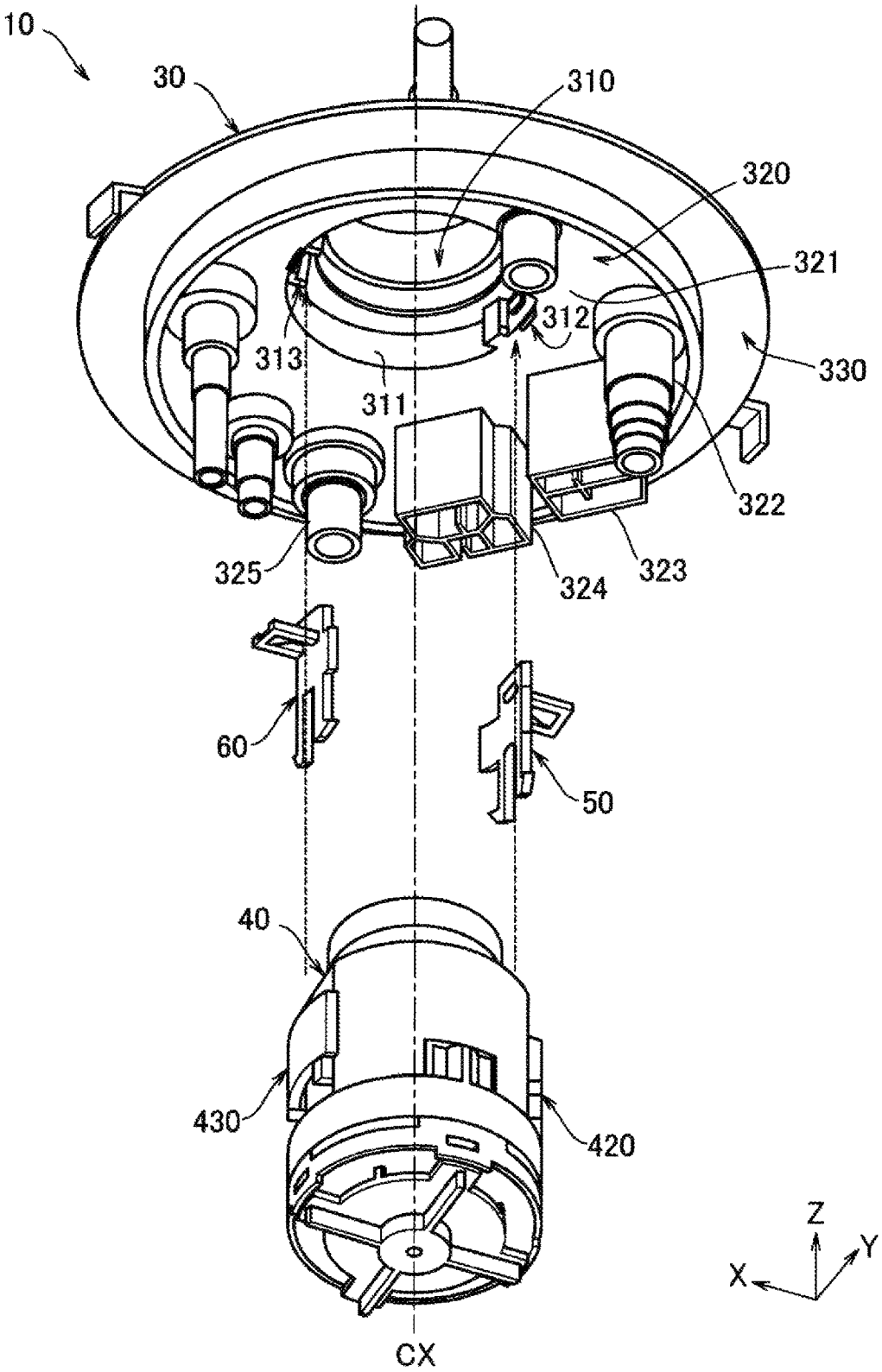
FIG. 1 is an exploded perspective view of a fuel supply device of a first embodiment.

As shown in the exploded perspective view of FIG. 1, the fuel supply device 10 of the first embodiment has a lid member 30, an on-off valve 40 mounted to the lid member 30, and a pair of arm members 50 and 60 which mounts the on-off valve 40 to the lid member 30. The on-off valve 40 is one of a plurality of components configuring the fuel supply device 10, and is a functional component that functions to discharge fuel vapor in an internal volume of the fuel tank 20 by opening and closing. The fuel supply device 10 also has components performing various functions such as a fuel pump, a pressure sensor, and the like, but the illustration and description are omitted here for convenience of explanation.

Figure 2:
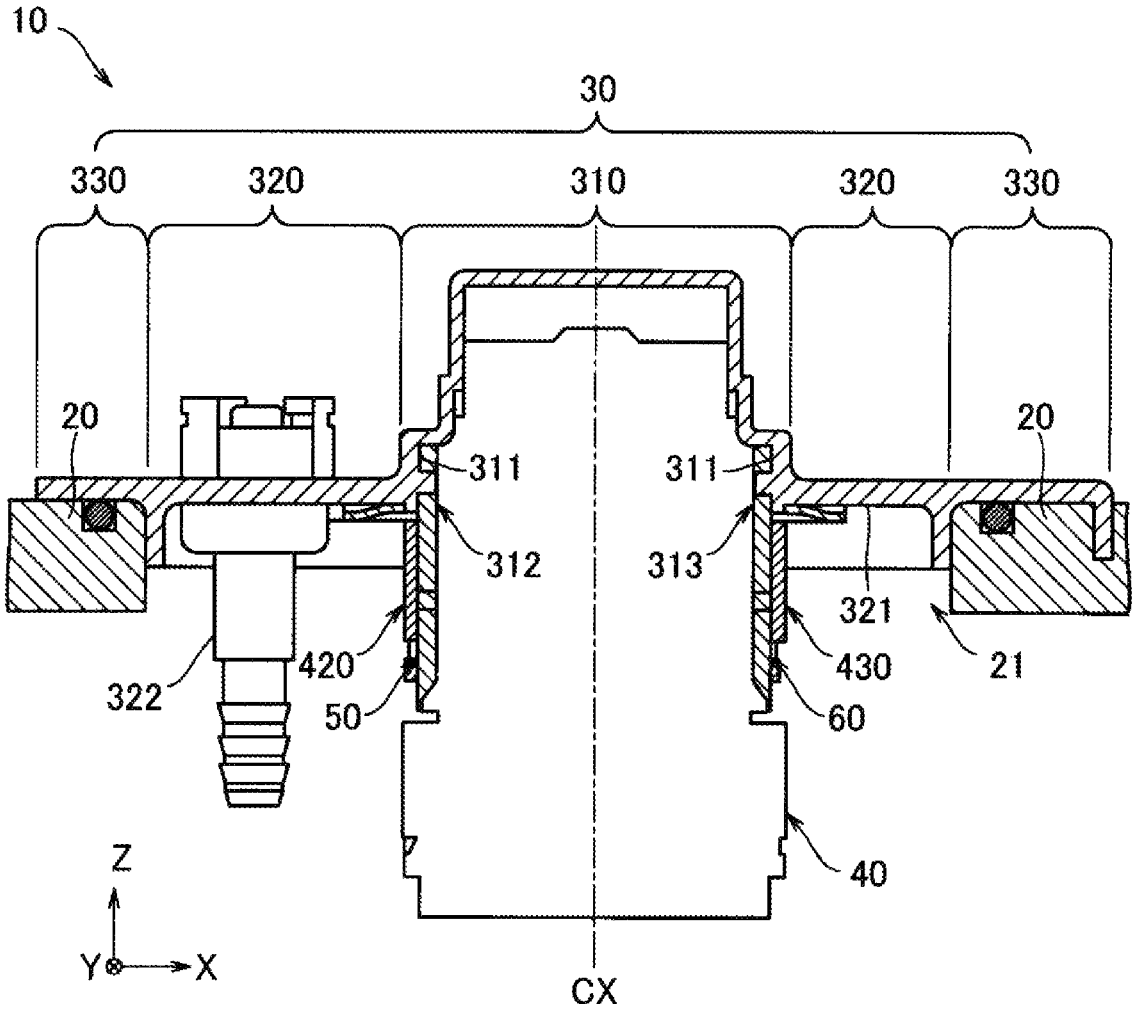
FIG. 2 is a cross-sectional view of the fuel supply device attached to a fuel tank.

As shown in the cross-sectional view of FIG. 2, the fuel supply device 10 is mounted to an outer wall of the fuel tank 20 at the opening 21 on an upper portion of the fuel tank 20 so that the on-off valve 40 mounted on the lid member 30 is arranged in the internal volume of the fuel tank 20, and the lid member 30 covers the opening 21.

As shown in FIG. 2, the lid member 30, when it is mounted on the fuel tank 20, has a valve mounting portion 310 arranged in a region of the opening 21 of the fuel tank 20, a component flange portion 320 on an outside thereof, and an mounting flange portion 330 coming into contact with an upper wall surface of the fuel tank 20.

As shown in FIG. 1 and FIG. 2, the valve mounting portion 310 has a cylindrical shape which opens at a lower side and protrudes upward, and is a portion in which an upper portion of the on-off valve 40 is inserted into the cylindrical portion and mounted. A central axis CX indicates the central axis of the valve mounting portion 310. The on-off valve 40 is mounted so that its own central axis coincides with the central axis CX.

As shown in FIG. 1 and FIG. 2, the component flange portion 320 of both surfaces are attachment portions for various parts and various ports such as a fuel port 322 connected to the fuel pump, connector ports 323 and 324 for connection cables to components such as the on-off valve 40 and the fuel pump, and a pressure sensor port 325 and the like.

The mounting flange portion 330 is a portion to be mounted on the upper wall surface of the fuel tank 20.

As shown in FIG. 1 and FIG. 2, an inner side surface 311 of a lower end of the valve mounting portion 310 and an edge portion of a lower surface 321 of the component flange portion 320 adjacent to the inner side surface 311 are provided with lid member side mounting portions 312 and 313 corresponding to and facing to the pair of arm members 50 and 60. The pair of arm members 50 and 60 are mounted on the corresponding lid member side mounting portions 312 and 313. The on-off valve 40 is mounted to the lid member 30 by engaging the arm members 50 and 60 with the component side mounting portions 420 and 430 provided on the outer surface of the on-off valve 40.

In FIG. 1 and FIG. 2, the +Z direction indicates an upward direction which is a direction to insert the on-off valve 40 into the valve mounting portion 310 in order to mount the on-off valve 40 on the lid member 30 via the arm members 50 and 60. This +Z direction, i.e., the upward direction corresponds to a first direction in which the component is mounted to the arm member. Further, the X direction is orthogonal to the Z direction and indicates a direction in which the arm members 50 and 60 mounted on the lid member side mounting portions 312 and 313 face each other. The +X direction indicates a direction from one arm member 50 toward the other arm member 60. The X direction corresponds to a second direction orthogonal to the first direction and facing the arm member side. The Y direction indicates a direction orthogonal to the Z direction and the X direction. The X, Y, and Z directions are the same in the following figures.

Figure 3:
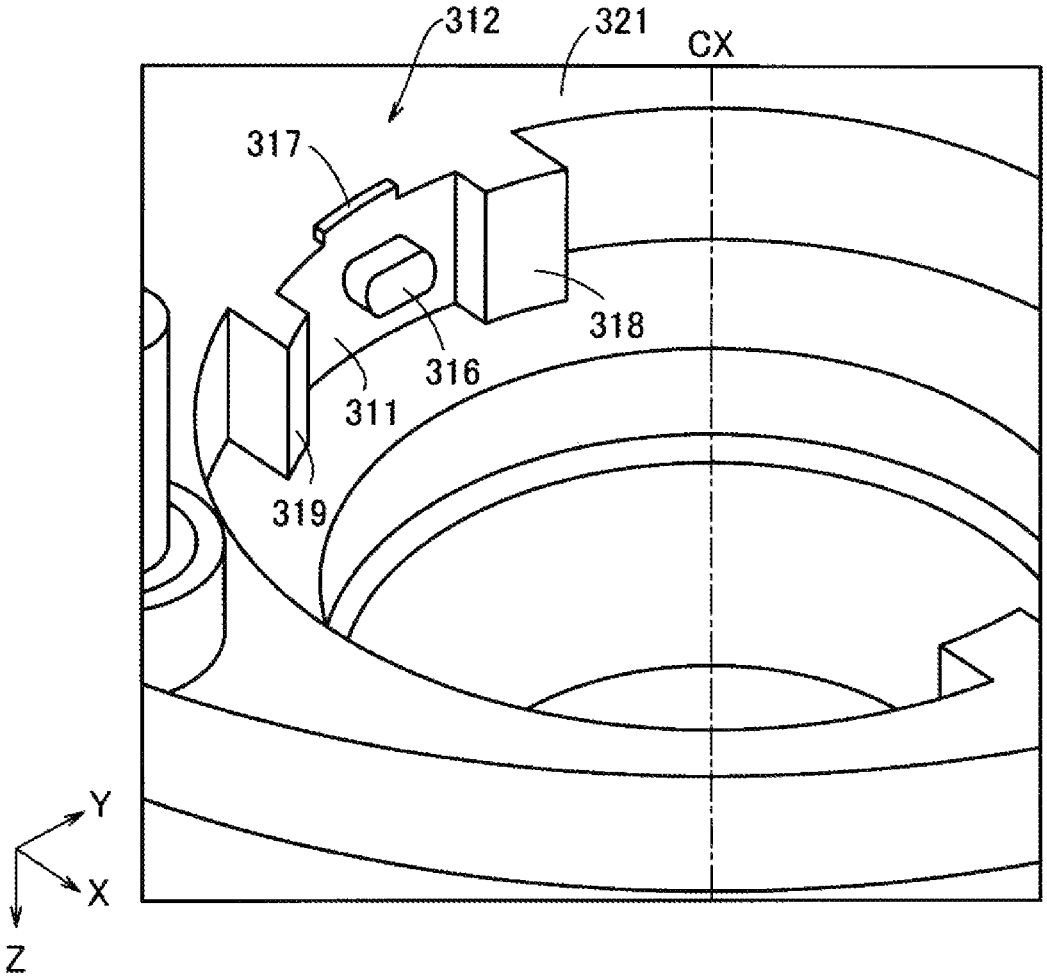
FIG. 3 is a perspective view showing an arm mounting portion formed on a lid member.

As shown in FIG. 3, one lid member side mounting portion 312 is provided on the inner side surface 311 along the Z direction, and has a first convex portion 316 protruding along the X direction, walls 318 and 319 provided on both sides of the first convex portion 316, and a second convex portion 317 protruding in the −Z direction from the lower surface 321 which faces towards the −Z direction and adjacent to the lower end edge of the inner side surface 311 at a lower portion of the first convex portion 316. The other lid member side mounting portion 313 is the same as the other lid member side mounting portion 312, although not shown.

Figure 4:
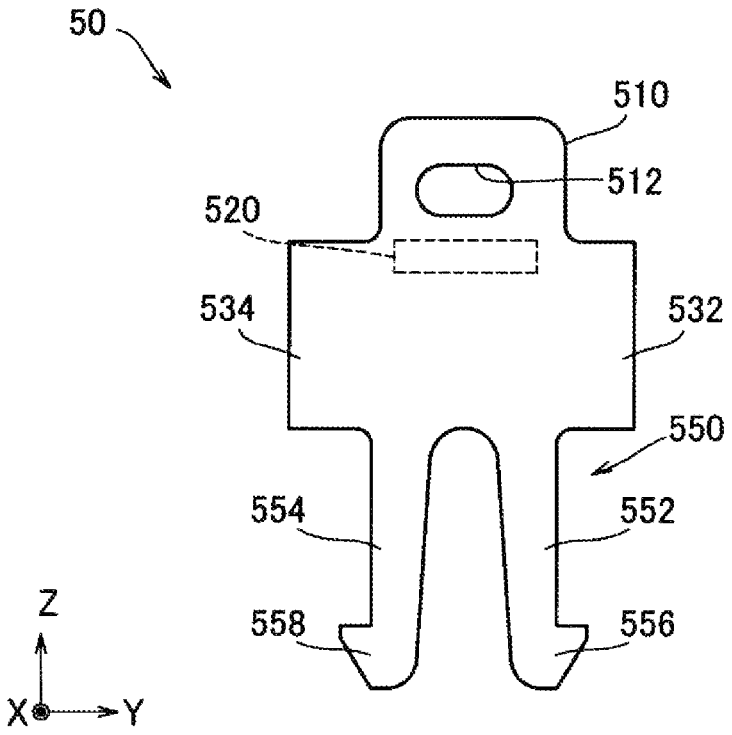
FIG. 4 is a front view showing an arm member.
Figure 5:
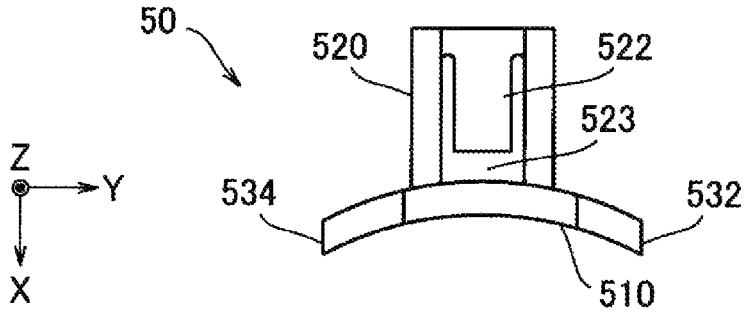
FIG. 5 is a plan view of the arm member viewed from above.

As shown in FIG. 4 and FIG. 5, the arm member 50 mounted on the lid member side mounting portion 312 has a first engaging portion 510 along the +Z direction, a second engaging portion 520 extending along the −X direction from the first engaging portion 510, and an engaging arm portion 550 extending along the −Z direction.

The first engaging portion 510 has a concave portion 512 into which the first convex portion 316 (FIG. 3) of the lid member side mounting portion 312 is fitted. The concave portion 512 is a through hole having an outer shape corresponding to the shape of the first convex portion 316. Further, the arm member 50 has flange portions 532 and 534 that protrude asymmetrically in the horizontal direction at a lower portion, i.e., in the −Z direction, lower than the concave portion 512. Both left and right side portions on the concave portion 512 located above the flange portions 532 and 534 have concave shapes corresponding to the walls 318 and 319 (FIG. 3) of the lid member side mounting portion 312.

The second engaging portion 520 has a tab 522 on which a distal end side end portion (−X direction side in FIG. 5) is fixed, and a root side end portion is freed to be elastically deformable in the ±Z direction. A gap 523 formed on a free end side of the tab 522 forms a concave portion that engages with the second convex portion 317, as is described later.

The engaging arm portion 550 has a pair of arm portions 552 and 554 arranged along the Y direction. Each of the pair of arm portions 552 and 554 are able to be elastically deformed (which may be called a tension deformation) in the Y direction, more specifically, in a direction approaching to the other side, and have engaging claws 556 and 558 protruding towards opposite to each other on distal ends.

Figure 6:
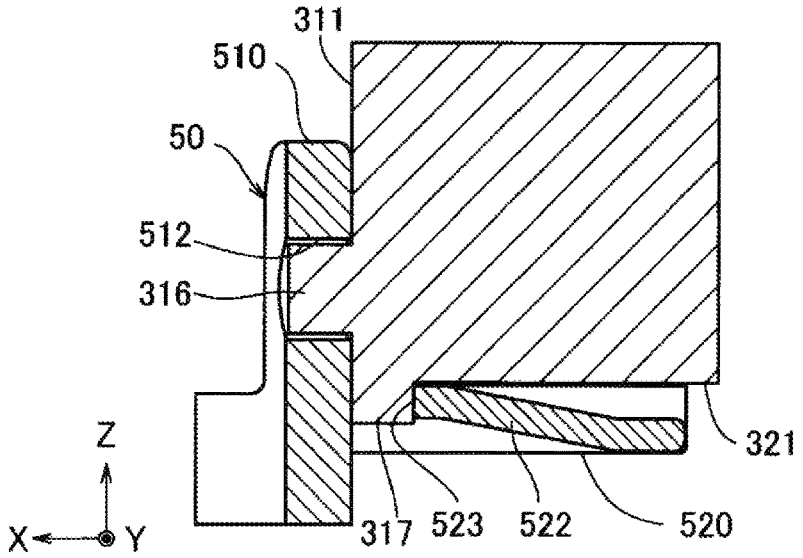
FIG. 6 is a cross-sectional view showing a state in which the arm member is mounted on a lid member side mounting portion.

As shown in the cross-sectional view of FIG. 6, one arm member 50 is mounted to the corresponding lid member side mounting portion 312 by the first engaging portion 510 and the second engaging portion 520. Movement of the arm member 50 in the Z direction and the Y direction are prevented by engaging the first convex portion 316 (FIG. 3) into the concave portion 512 of the first engaging portion 510 and placing the first engaging portion 510 between the walls 318 and 319 (FIG. 13) in a sandwiching manner.

Figure 7:
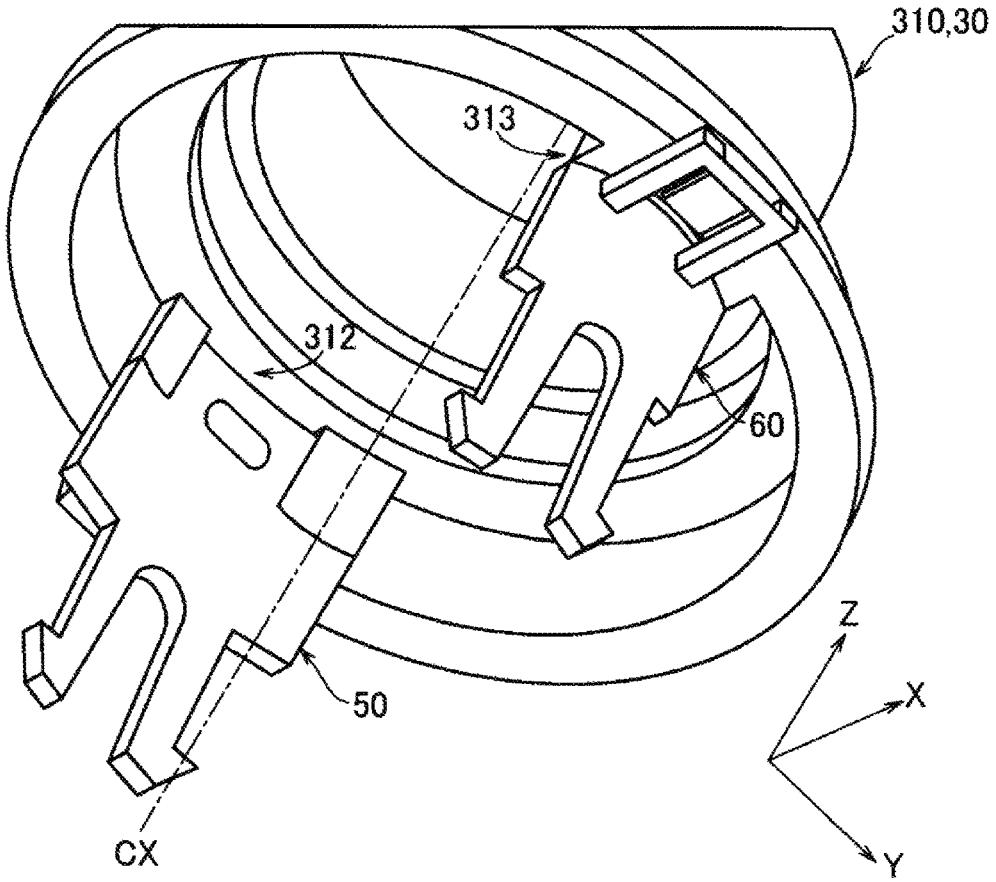
FIG. 7 is a perspective view showing a state in which the arm members are mounted on the lid member side mounting portions.

Further, movement of the arm member 50 in the X direction is prevented by fitting the gap 523 of the tab 522 and the second convex portion 317 by press fitting the open end of the tab 522 of the second engaging portion 520 along the surface of the lower surface 321 side of the second convex portion 317 (FIG. 3). As a result, as shown in FIG. 7, one arm member 50 can be mounted to the corresponding lid member side mounting portion 312.

The lid member side mounting portion 312, specifically, the first convex portion 316 corresponds to the first engaging portion. The first engaging portion 510 of the arm member 50, specifically, the concave portion 512 corresponds to the first engaged portion. Further, the lid member side mounting portion 312, specifically, the second convex portion 317 corresponds to the second engaging portion. The second engaging portion 520 of the arm member 50, specifically, the gap 523 of the tab 522 corresponds to the second engaged portion.

The other arm member 60 and the corresponding lid member side mounting portion 313 also have the same structure as the one arm member 50 and the corresponding lid member side mounting portion 312. As shown in FIG. 7, the other arm member 60 can also be mounted on the corresponding lid member side mounting portion 313.

One arm member 50 and the corresponding lid member side mounting portion 312 and the other arm member 60 and the corresponding lid member side mounting portion 313 have shapes opposite in the left-right direction (Y direction). This prevents them from being mounted in different combinations.

Figure 8:
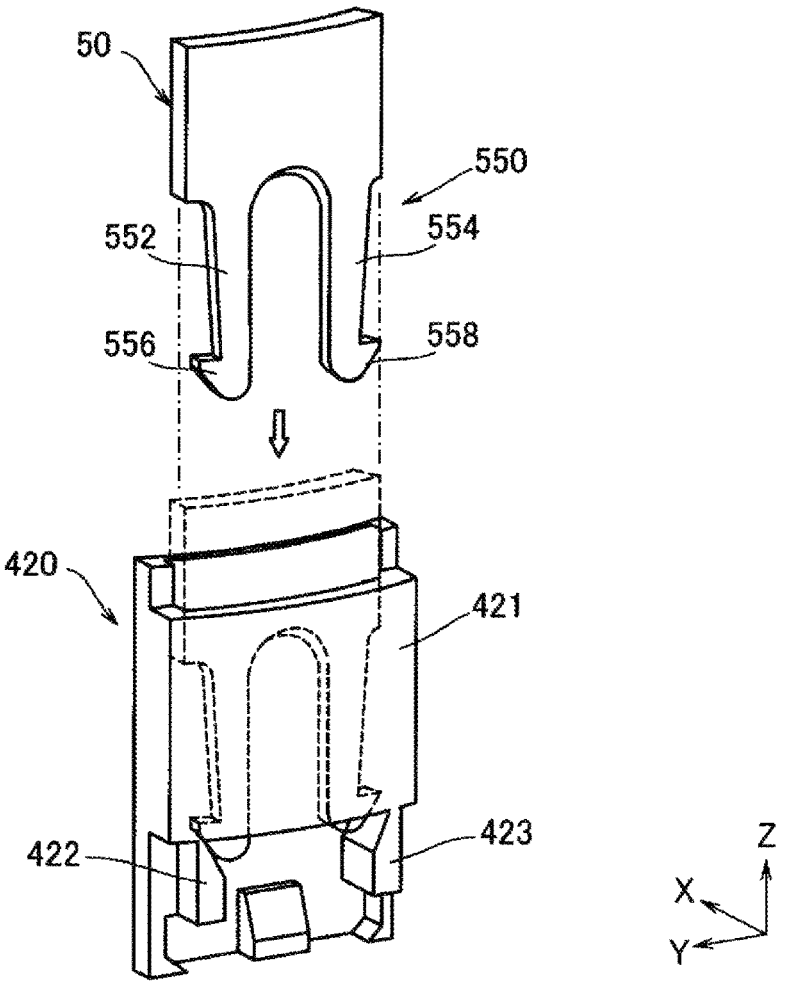
FIG. 8 is a perspective view showing a process in which the arm member is mounted to a corresponding component side mounting portion.
Figure 9:
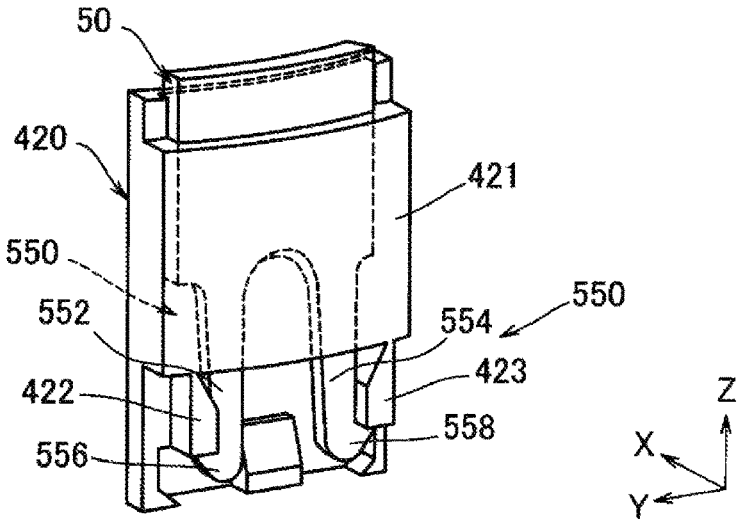
FIG. 9 is a perspective view showing a state in which the arm member is mounted to the component side mounting portion.

When mounting the on-off valve 40, the on-off valve 40 is inserted from below the pair of arm members 50 and 60 shown in FIG. 7 toward the mounting position in the +Z direction with the central axis CX as the center. At this time, as shown in FIG. 8, the pair of arm portions 552 and 554 (FIG. 4) of the engaging arm portion 550 of one arm member 50 are inserted toward the pair of engaged portions 422 and 423 on lower ends of the engagement guide 421 of the component side mounting portion 420 (FIG. 1) formed on the outer surface of the on-off valve 40. At this time, the engaging claws 556 and 558 at the distal ends of the pair of arm portions 552 and 554 become a state to narrow a distance between them under the tension deformation when moving along the engaged portions 422 and 423, and are freely released after passing through between the engaged portions 432 and 433. As a result, as shown in FIG. 9, the engaging claws 556 and 558 are fitted with the gaps below the corresponding engaged portions 422 and 423, respectively, and the on-off valve 40 is engaged with the arm member 50. That is, the engaging arm portion 550 of the arm member 50 and the component side mounting portion 420 of the on-off valve 40 form the snap-fit structure which is an engaging structure engaging the arm member 50 and the on-off valve 40 by elastic deformation of the arm portions 552 and 554.

The other arm member 60 and the corresponding component side mounting portion 430 also have the same structure as the one arm member 50 and the corresponding component side mounting portion 420, therefore, and the other component side mounting portion 430 of the on-off valve 40 is engaged with the arm member 60 when the on-off valve 40 is mounted.

Figure 10:
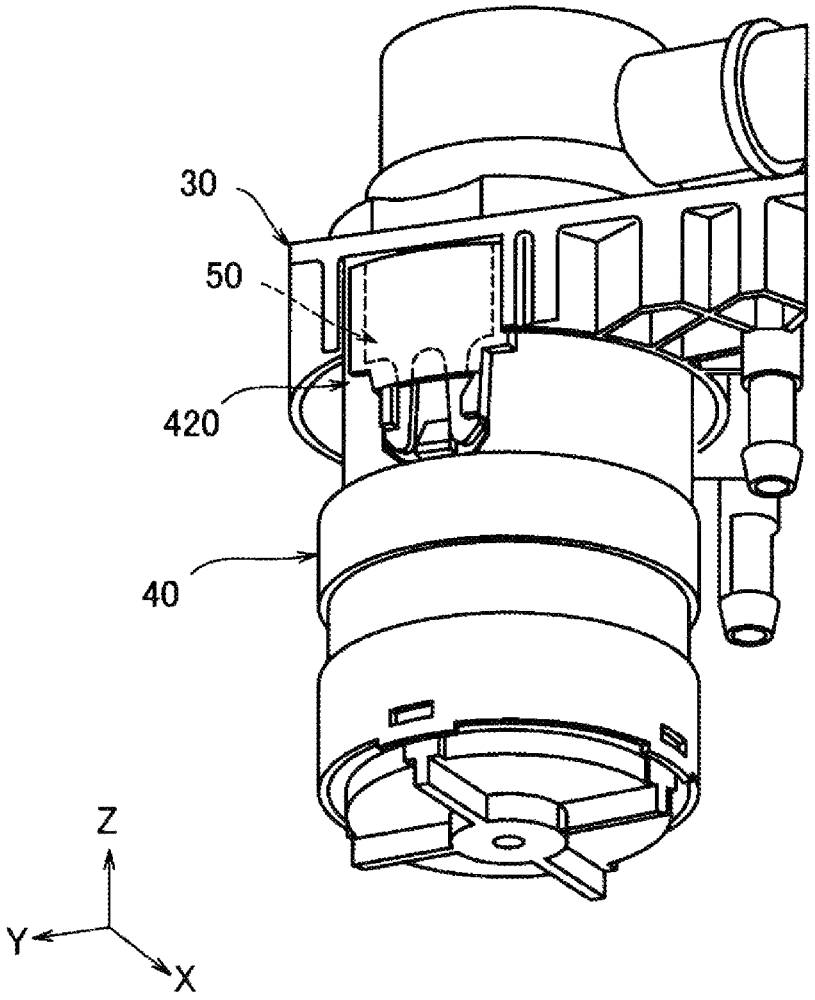
FIG. 10 is a perspective view showing a state in which an on-off valve is mounted to a lid member using the arm member.

As described above, as shown in FIG. 10, the on-off valve 40 is engaged with the arm members 50 and 60 and mounted on the lid member 30 by the snap-fit structure configured by a pair of component side mounting portions 420 and 430 of the on-off valve 40 and the engaging arm portions 550 and 550 of the corresponding arm members 50 and 60.

Figure 11:
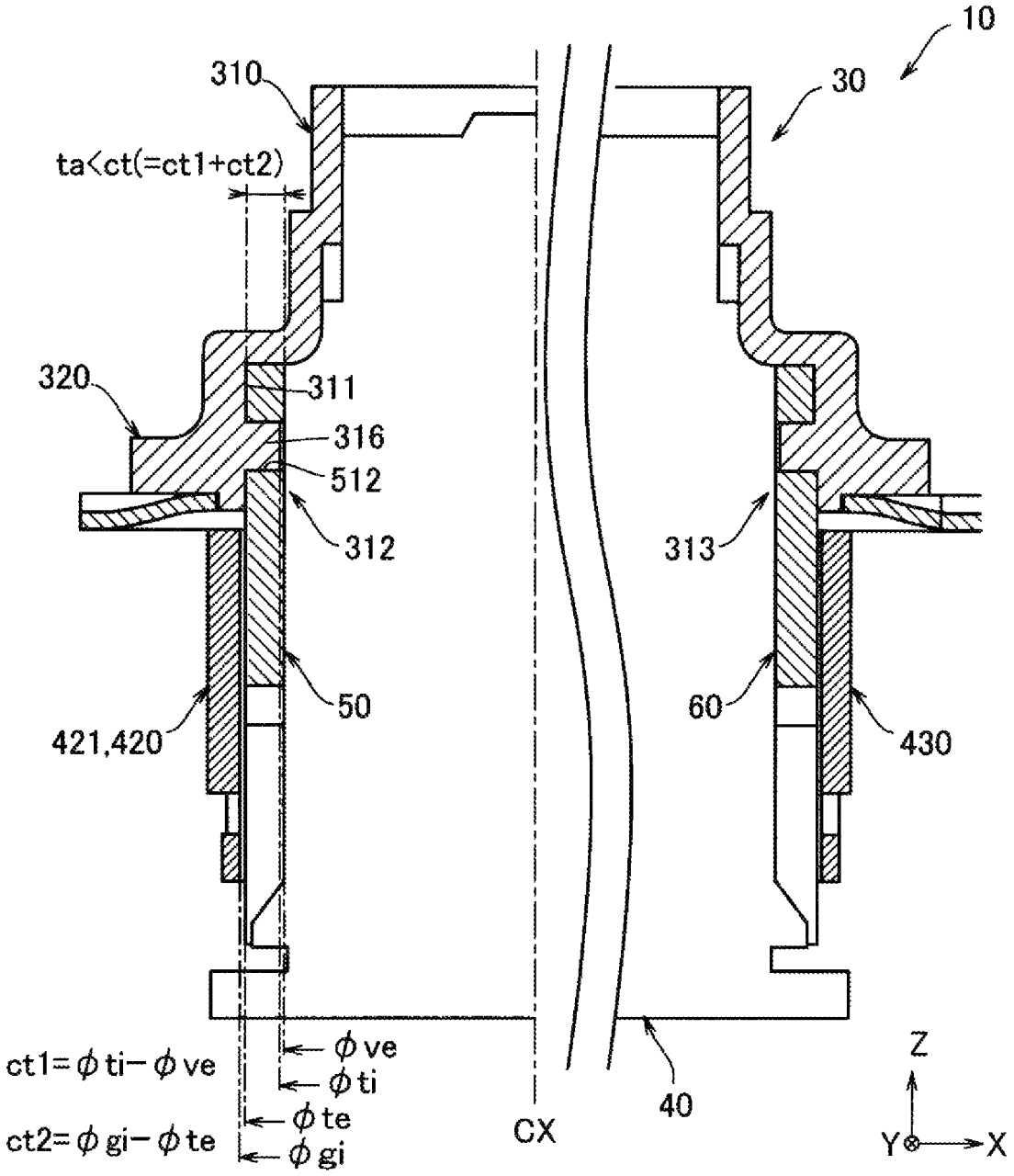
FIG. 11 is a cross-sectional view showing the arm members mounted on the lid member, and the on-off valve mounted on the arm members.

Here, as shown in FIG. 11, in a state where the on-off valve 40 is mounted to the lid member 30 via the arm members 50 and 60, it is desirable that a thickness to of the arm member 50 is larger than the clearance ct as shown in the following equation (1).

$$ta<ct \tag{1}$$

Here, the clearance ct is represented by a sum of a first clearance ct1 and a second clearance ct2 as shown in the following equation (2).

$$ct=ct1+ct2 \tag{2}$$

Further, as shown in the following equation (3), the first clearance ct1 is represented by a difference of a diameter φti of a distal end surface of the first convex portion 316 of the lid member side mounting portion 312 and a diameter φve of the outer surface where the component side mounting portion 420 of the on-off valve 40 is provided. It should be noted that each of the above diameters indicates the length from the central axis CX (FIG. 11), and the same applies to the following description.

$$ct1=\varphi ti-\varphi ve \tag{3}$$

Further, as shown in the following equation (4), the second clearance ct2 is represented by a difference of a diameter φgi of the inner wall surface of the engaging guide 421 of the component side mounting portion 420 and a diameter φte of the side surface of the root side of the first convex portion 316 of the lid member side mounting portion 312.

$$ct2=\varphi gi-\varphi te \tag{4}$$

Here, the first clearance ct1 indicates a gap between the outer surface of the on-off valve 40 and the tip surface of the first convex portion 316 on the outer side of the outer surface. Further, the second clearance ct2 indicates a gap between the surface on the root side of the first convex portion and the inner wall surface of the engaging guide 421 as the surface of the on-off valve 40 on an outer side of the first convex portion. That is, the clearance ct indicates a gap between the first convex portion 316 and the on-off valve 40.

As shown in the equation (1), if the thickness ta of the arm member 50 is larger than the clearance ct, the body of the on-off valve 40 causes the concave portion 512 of the arm member 50 to be formed from the first convex portion 316. The movement of the arm member 50 in the X direction can be prevented so that the arm member 50 does not fall off.

The arm member 60 is the same as the arm member 50, as shown in the equation (1), it is desirable that the thickness ta of the arm member 60 is larger than the clearance ct in a state that the on-off valve 40 is mounted on the lid member 30 via the arm member 60.

The lid member 30 is mounted on the outer wall of the fuel tank 20 as shown in FIG. 2. Therefore, as described in the prior art, the outer surface of the lid member 30 may be oxidized, deteriorated, and damaged by water, acidic deposits, or the like. Therefore, in the first embodiment, the lid member 30 is formed by injection molding or the like using a resin material having acid resistance, for example, PPS, PPA, or the like. The presence or absence of acid resistance is generally determined by measuring a degree of deterioration in a strength of the member due to immersion in an acid such as sulfuric acid. For example, if the degree of deterioration of the measured strength is less than a predetermined degree, it may be determined to have acid resistance, and if it is more than a predetermined degree, it may be determined to have no acid resistance.

As shown in FIG. 8 and FIG. 9, the arm members 50 and 60 make the engaging claws 556 and 558 of the elastically deformed arm portions 552 and 554 to be engaged with the engaged portions 422 and 423 of the component side mounting portions 420 and 430 of the on-off valve 40. Therefore, the arm members 50 and 60 are required to be members that are elastically deformed easily and have high toughness.

Here, since the acid-resistant resin material (PPS, etc.) used in the lid member 30 generally has a very small elastic modulus and a very small toughness, it is difficult to use as a resin material for the arm members 50 and 60.

Therefore, in the first embodiment, the arm members 50 and 60 are formed by injection molding or the like by using a resin material having a large elastic modulus and toughness, for example, POM (Polyoxymethylene, Polyacetal), PA (Polyamide), PE (Polyethylene), or the like. That is, the arm members 50 and 60 are formed separately from the lid member 30.

As described above, the fuel supply device 10 of the first embodiment uses the arm members 50 and 60 formed by using the resin material having a large elastic modulus and high toughness as compared with the resin material of the lid member 30, separately from the lid member 30. Thereby, the on-off valve 40 can be mounted to the lid member 30 by using the snap-fit structure in which the arm members 50 and 60 and the on-off valve 40 are engaged by the elastic deformation of the arm members. The magnitude of the elastic modulus is generally determined from the magnitude of the Young's modulus.

Further, the fuel supply device 10 uses the lid member 30 formed of a resin material having acid resistance. As a result, it is possible to improve the acid resistance of the lid member 30 and attaching of the on-off valve 40 to the lid member 30 using the snap-fit structure, which is one of the engaging structures.

Further, as described above, it is possible to prevent the movement of the arm member 50 in the X direction by using the body of the on-off valve 40 so that the concave portion 512 of the arm member 50 does not fall out from the first convex portion 316. Therefore, it is easy to design and cost reduction with respect to a dimensional accuracy requirement for the components and a deformation according to a usage environment.

As described above, the first convex portions 316 of the lid member side mounting portions 312 and 313 corresponding to the first engaging portions, which are fitted with the concave portions 512 corresponding to the first engaged portions of the arm members 50 and 60, are arranged on a position located on a side in the component assembling +Z direction than the lower surface 321 of the component flange portion 320 on the outer side of the valve mounting portion 310 on which the on-off valve 40 as the component is arranged (FIG. 1 and FIG. 2). As a result, the degree of freedom in arranging the arm members 50 and 60 can be increased as compared with a case where the first convex portion 316 of the lid member side mounting portions 312 and 313 is provided on the component flange portion 320 on which various parts are formed.

As described above, a configuration (FIG. 6), which have the first convex portion 316 as the first engaging portion and the concave portion 512 as the first engaged portion, and the second convex portion 317 as the second engaging portion and the second engaging portion 520 having the gap 523 of the tab 522 as the second engaged portion, is provided in the arm members 50 and 60 and the corresponding lid member side mounting portions 312 and 313. According to this configuration, it is possible to improve an easiness and a stability for mounting the arm member on the lid member.

B. Second Embodiment

Figure 12:
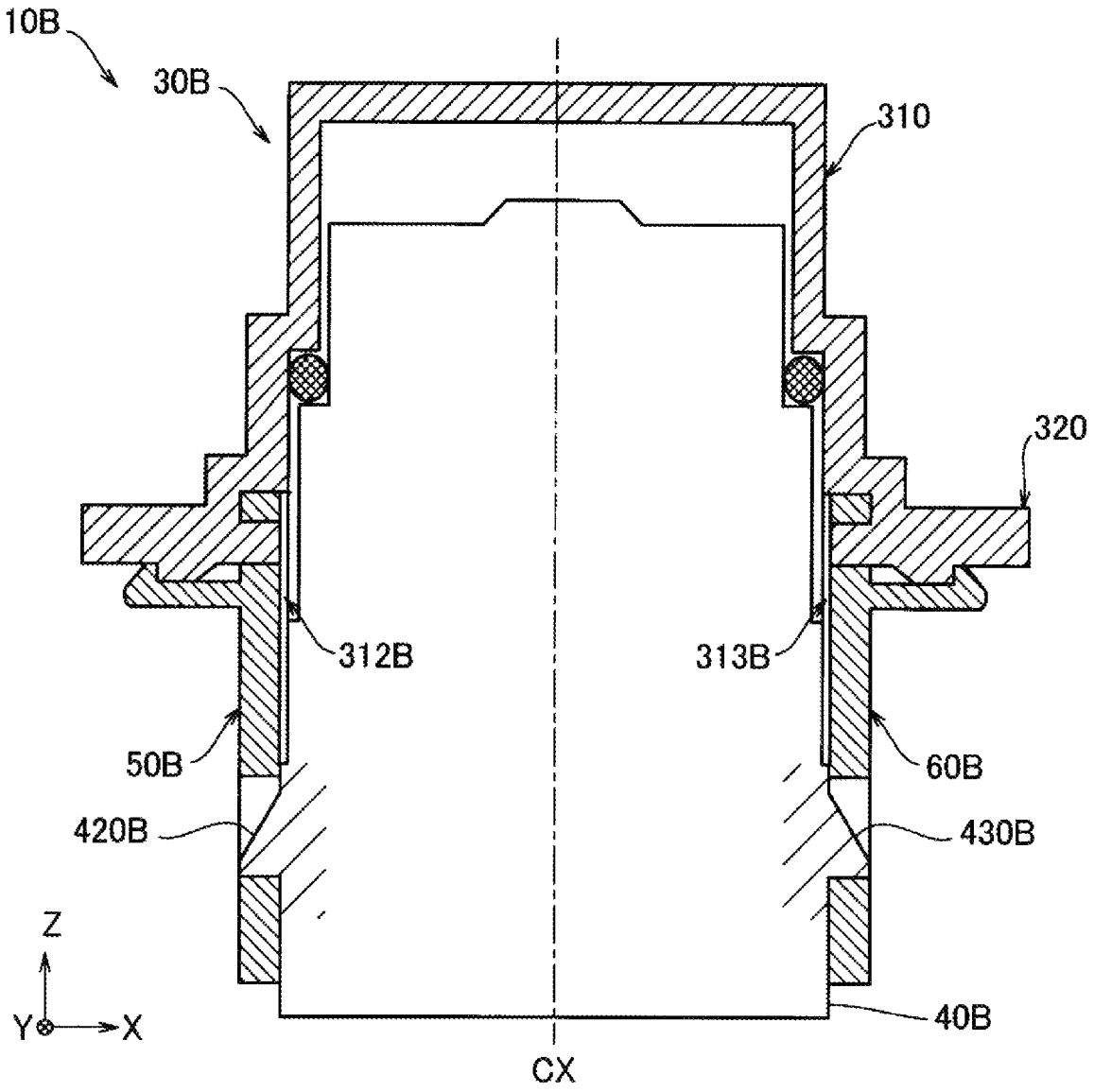
FIG. 12 is a cross-sectional view of the fuel supply device of a second embodiment.

As shown in FIG. 12, the fuel supply device 10B of the second embodiment has a lid member 30B, an on-off valve 40B mounted to the lid member 30B, and a pair of arm members 50B and 60B which mounts the on-off valve 40B to the lid member 30B. Note that the same reference signs as those in the first embodiment indicate the same configuration, and refer to the preceding descriptions.

As is described later, the arm members 50B and 50B have different configurations from the arm members 50 and 60 of the first embodiment. The lid member 30B is configured to have later described lid member side mounting portions 312B and 313B in accordance with the configurations of the arm members 50B and 60B, but the other configurations are similar to the lid member 30 (FIG. 1 and FIG. 2). The on-off valve 40B is configured to have later described component side mounting portions 420B and 430B in accordance with the configurations of the arm members 50B and 60B, but the other configurations are the same as the on-off valve 40.

Figure 13:
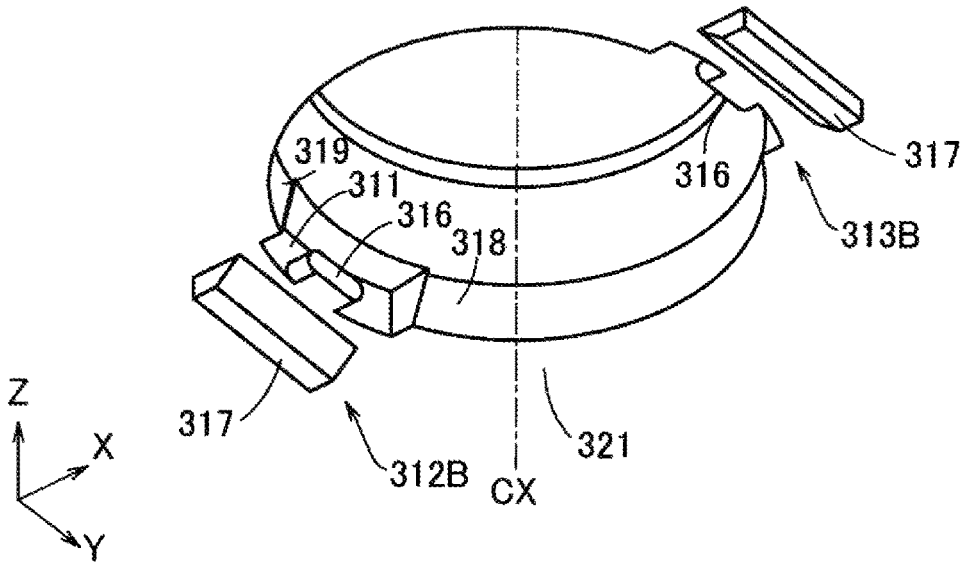
FIG. 13 is a perspective view showing arm mounting portions formed on the lid member.

As shown in FIG. 13, the lid member side mounting portion 312B on which one arm member 50B is mounted has the first convex portion 316 and the walls 318 and 319 on both sides of the first convex portion 316 similar to the lid member side mounting portion 312 (FIG. 3). However, the first convex portion 316 of the lid member side mounting portion 312B is provided at a position where its lower end surface is in contact with the lower surface 321. Further, the lid member side mounting portion 312B includes a second convex portion 317 similar to the lid member side mounting portion 312. However, the second convex portion 317 of the lid member side mounting portion 312B is provided with a predetermined interval in the −X direction from the first convex portion 316. The lid member side mounting portion 313B on which the other arm member 60B is mounted is also the same as the one lid member side mounting portion 312B.

Figure 14:
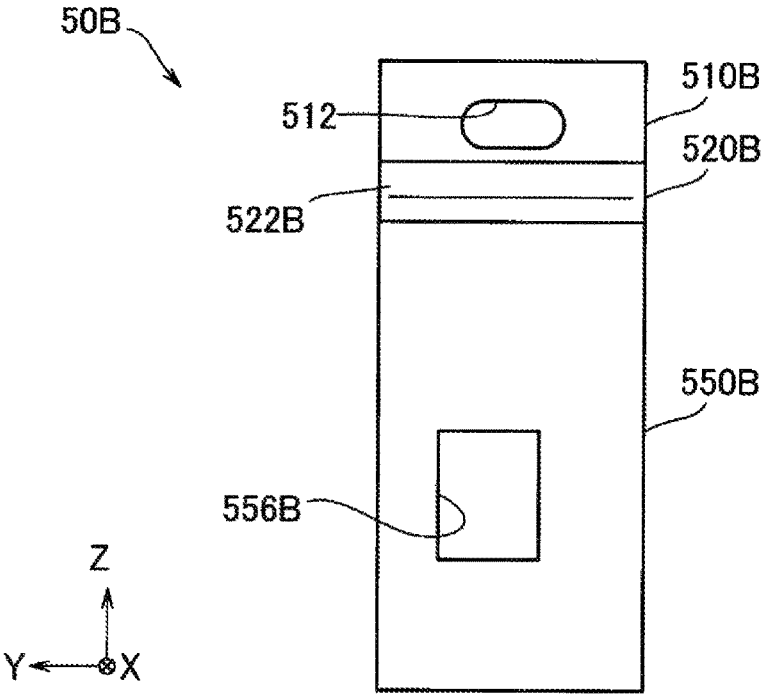
FIG. 14 is a front view showing an arm member.
Figure 15:
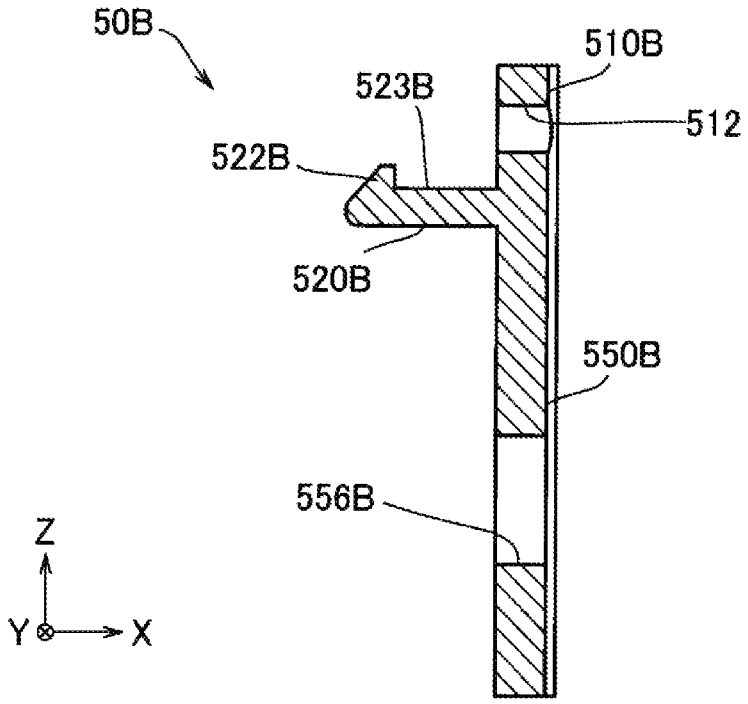
FIG. 15 is a cross-sectional view of the arm member.

As shown in FIG. 14 and FIG. 15, the arm member 50B mounted on the one lid member side mounting portion 312B has a first engaging portion 510B, a second engaging portion 520B, and an engaging arm portion 550B.

The first engaging portion 510B has the concave portion 512 similar to that of the first engaging portion 510 (FIG. 4). However, the first engaging portion 510B is not provided with a missing portion having in the first engaging portion 510 in accordance with the shape of the walls 318 and 319 (FIG. 13).

The second engaging portion 520B has an engaging convex portion 523B formed by an engaging convex portion 522B projecting in the +Z direction at the distal end instead of the tab 522 of the second engaging portion 520 (FIG. 5).

The engaging arm portion 550B can be an elastic deformation (the tension deformation) so that the distal end side expands in the −X direction, and has an engaging convex portion 556B formed by a through hole.

Figure 16:
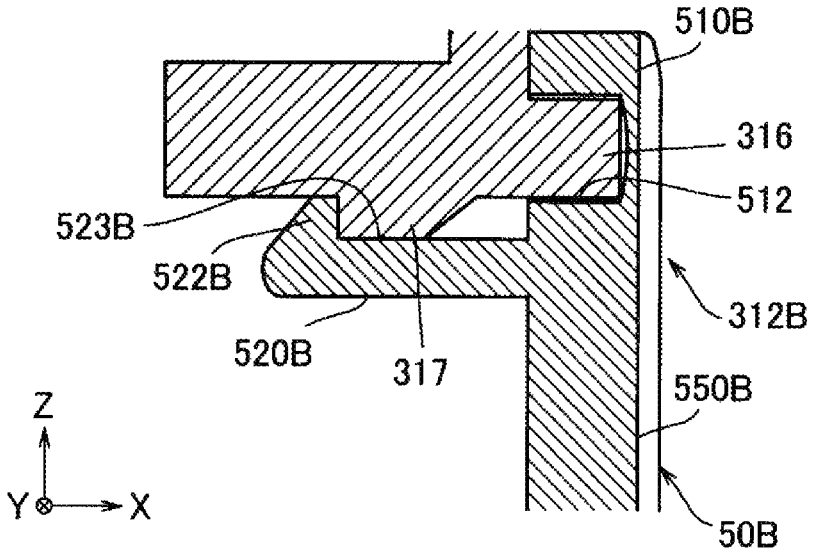
FIG. 16 is a cross-sectional view showing a state in which the arm member is mounted on the lid member side mounting portions.
Figure 17:
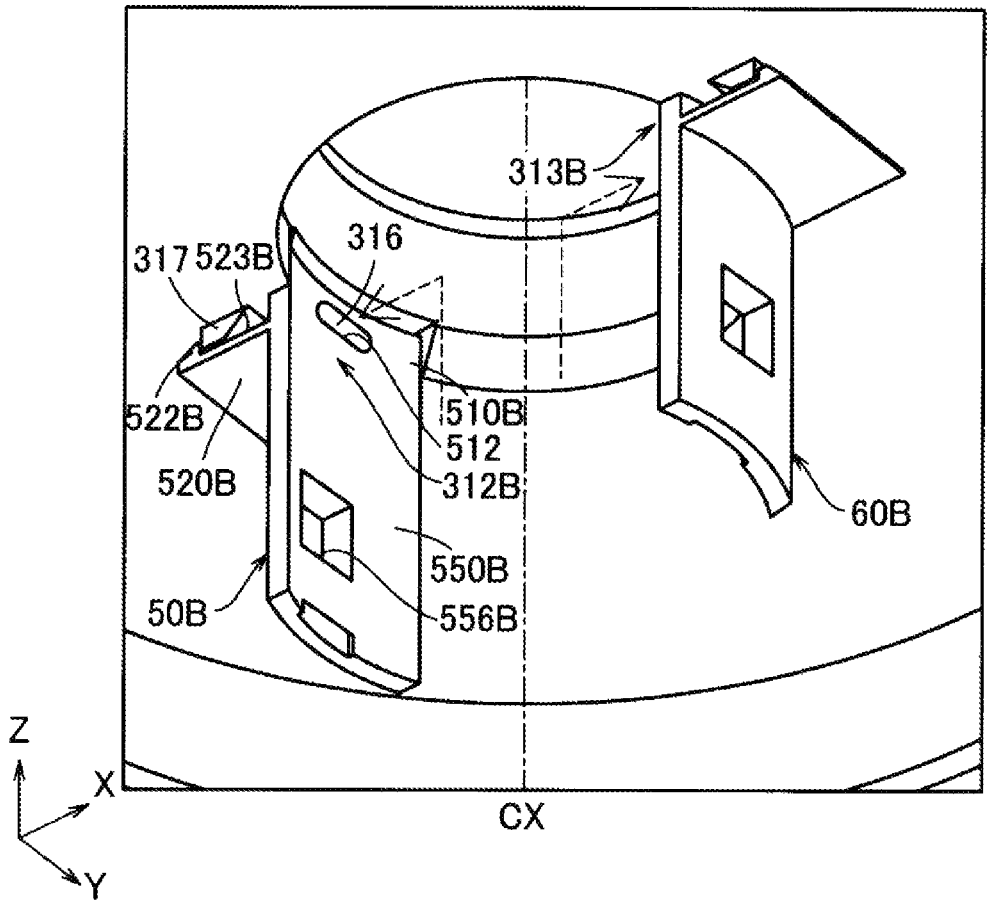
FIG. 17 is a perspective view showing a state in which the arm members are mounted on the lid member side mounting portions.

As shown in the cross-sectional view of FIG. 16, the arm member 50B described above is mounted on the corresponding lid member side mounting portion 312B by the first engaging portion 510B and the second engaging portion 520B. Movement of the arm member 50B in the Z direction and the Y direction are prevented by engaging the first convex portion 316 into the concave portion 512 of the first engaging portion 510B and placing the first engaging portion 510B between the walls 318 and 319 (FIG. 13) in a sandwiching manner. Further, the movement of the member 50B in the X direction is prevented by press-fitting the engaging convex portion 522B of the second engaging portion 520B to the −X direction side of the second convex portion 317 and engaging the engaging concave portion 523B and the second convex portion 317. As a result, as shown in FIG. 17, one arm member 50 can be mounted to the corresponding lid member side mounting portion 312. The arrow shown by the broken line in FIG. 17 indicates the direction in which the arm member 50B is mounted on the lid member side mounting portion 312B.

The first convex portion 316 of the lid member side mounting portion 312B corresponds to the first engaging portion. The concave portion 512 of the first engaging portion 510B of the arm member 50B corresponds to the first engaged portion. Further, the second convex portion 317 of the lid member side mounting portion 312B corresponds to the second engaging portion. The engaging concave portion 523B formed by the engaging convex portion 522B of the second engaging portion 520 of the arm member 50B corresponds to the second engaged portion.

The other arm member 60B and the corresponding lid member side mounting portion 313B also have the same structure as the one arm member 50B and the corresponding lid member side mounting portion 312B. As shown in FIG. 17, the other arm member 60B can also be mounted on the corresponding lid member side mounting portion 313B.

Figure 18:
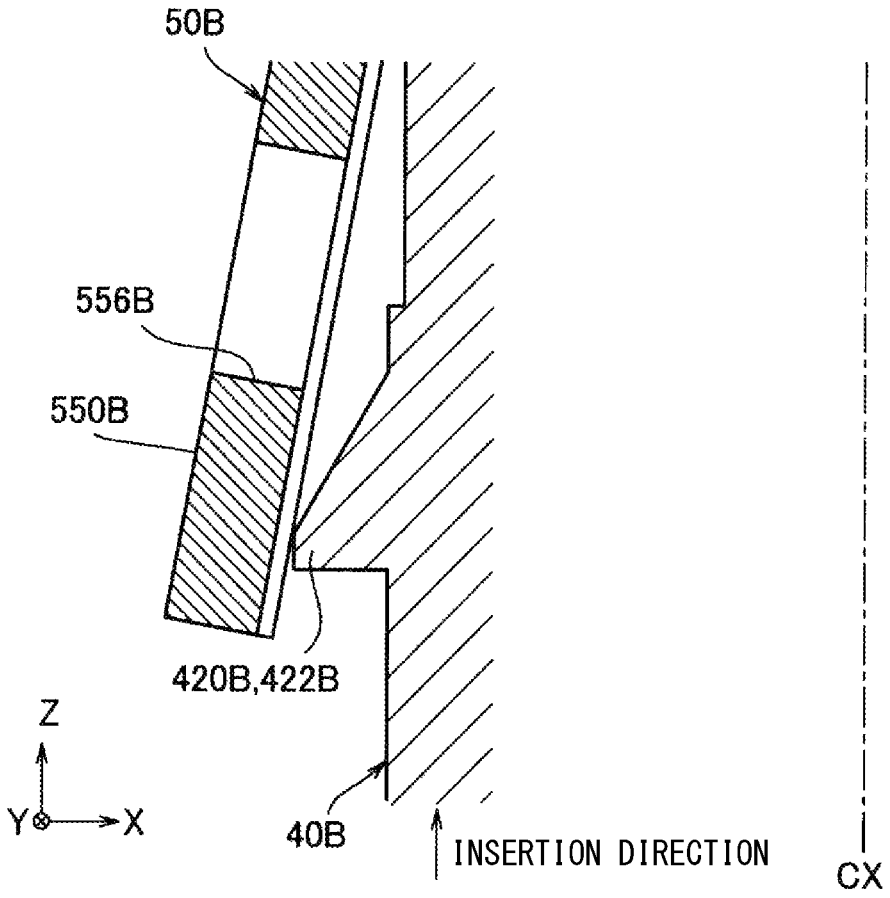
FIG. 18 is a perspective view showing a process in which the arm member is mounted to a corresponding component side mounting portion.
Figure 19:
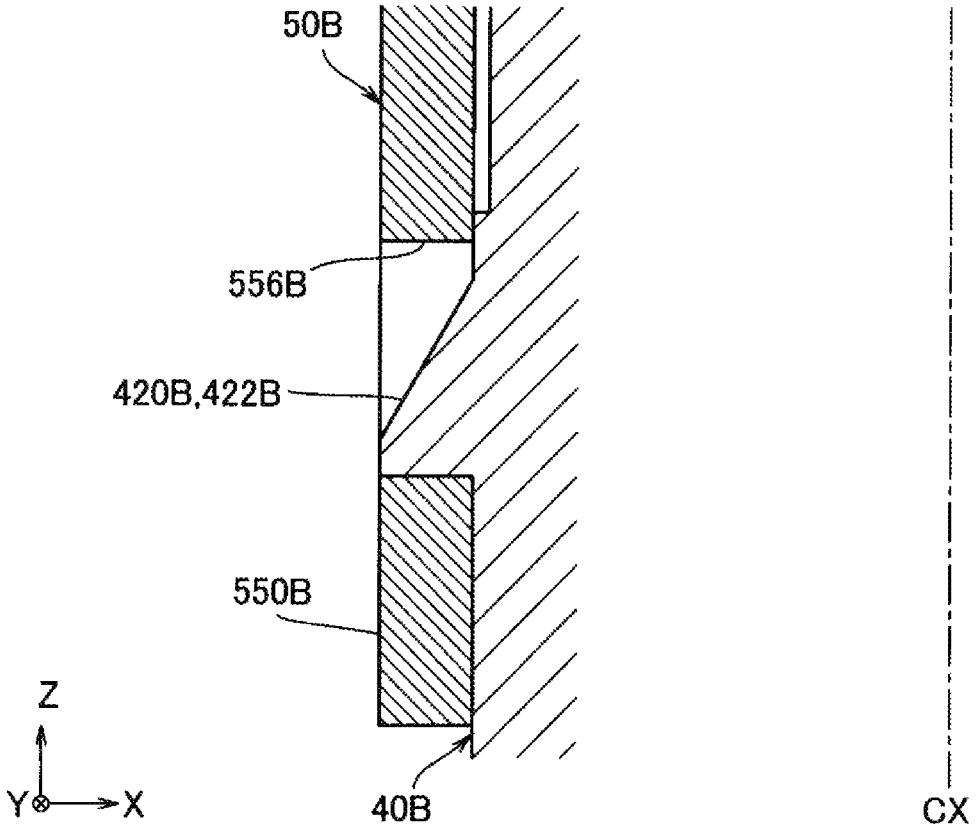
FIG. 19 is a perspective view showing a state in which the arm member is mounted to the component side mounting portion.

When mounting the on-off valve 40B, the on-off valve 40B is inserted from below the pair of arm members 50B and 60B shown in FIG. 17 toward the mounting position in the +Z direction with the central axis CX as the center. At this time, as shown in FIG. 18, the engaging arm portion 550B (FIG. 15) of one arm member 50B becomes a state expanded in the −X direction under the tension deformation by the engaging convex portion 422B as the component side mounting portion 420B provided on the outer surface of the on-off valve 40B. Then, when the lower end of the engaging convex portion 422B reaches the engaging concave portion 556B, the engaging arm portion 550B is freely released. As a result, as shown in FIG. 19, the engaging convex portion 422B of the on-off valve 40B and the engaging concave portion 556B of the arm member 50B are engaged with each other, and the on-off valve 40B is engaged with the arm member 50B. That is, the engaging arm portion 550B of the arm member 50B and the component side mounting portion 420B of the on-off valve 40B form the snap-fit structure which is an engaging structure engaging the arm member 50B and the on-off valve 40B by elastic deformation of the arm portions 552 and 554.

The other arm member 60B and the corresponding component side mounting portion 430B also have the same structure as the one arm member 50B and the corresponding component side mounting portion 420B, therefore, and the other component side mounting portion 430B of the on-off valve 40B is engaged with the arm member 60B when the on-off valve 40B is mounted.

As described above, as shown in FIG. 12, the on-off valve 40 is engaged with the arm members 50B and 60B and is mounted on the lid member 30B by the snap-fit structure configured by a pair of component side mounting portions 420B and 430B of the on-off valve 40 and the engaging arm portions 550 and 550D of the corresponding arm members 50B and 60B.

The fuel supply device 10B of the second embodiment can also obtain the same effect as the fuel supply device 10 of the first embodiment. Further, the second engaging portions 520B of the arm members 50B and 60B of the second embodiment are not the tabs 522 and the gaps 523 thereof of the arm members 50 and 60 of the first embodiment, but are configurations having the engaging convex portions 522B and the engaging concave portions 523B, therefore, it is possible to simplify the molding die structure used for forming the arm members.

C. Third Embodiment

The third embodiment is the same as the fuel supply device 10B of the second embodiment, except that the lid member side mounting portions 312C and 313C are different in shapes from the first convex portions 316 (FIG. 6) of the lid member side mounting portions 312B and 313B of the second embodiment. Note that the same reference signs as those in the first and the second embodiments indicate the same configuration, and refer to the preceding descriptions.

Figure 20:
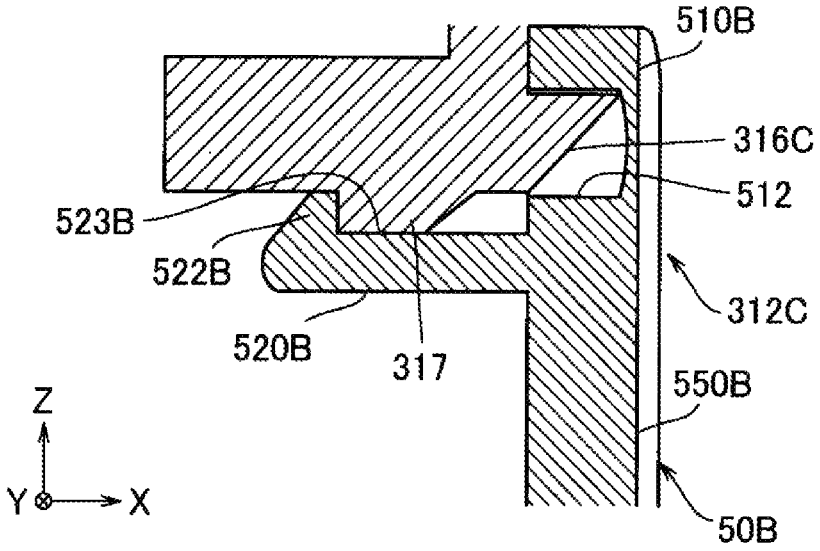
FIG. 20 is a cross-sectional view showing an arm member and a corresponding lid member side mounting portion of a third embodiment.

As shown in FIG. 20, the first convex portion 316C of one lid member side mounting portion 312C has a tapered shape having a protruding amount which increases towards the Z direction. The same applies to the other lid member side mounting portion 313C.

In a case of the lid member side mounting portions 312B and 313B of the second embodiment, as shown in FIG. 17 by the broken line arrow, it is necessary to fit the concave portions 512 to the first convex portions 316 after adjusting the vertical and horizontal position of the concave portions 512 of the arm members 50B and 60B with respect to the first convex portions 316 of the lid member side mounting portions 312B and 313B.

On the other hand, in the lid member side mounting portions 312C and 313C having the tapered first convex portions 316C, the arm members 50B and 60B can be mounted on the lid member side mounting portions 312C and 313C by displacing them in the Z direction during a state in which the arm members 50B and 60B come into contact with the tapered first convex portions 316C. That is, the arm members 50B and 60B can be easily mounted as compared with the lid member side mounting portions 312B and 313B of the second embodiment. In the third embodiment, it is possible to obtain the same effect as the first and second embodiment.

D. Fourth Embodiment

In the first to third embodiments, the on-off valve, which is a component mounted on the surface facing the opening side of the lid member covering the opening of the fuel tank, is described as an example. However, as described below, a component mounted on the surface facing an opposite side to the opening side, i.e., facing an outside of the fuel tank may be mounted via the arm member.

Figure 21:
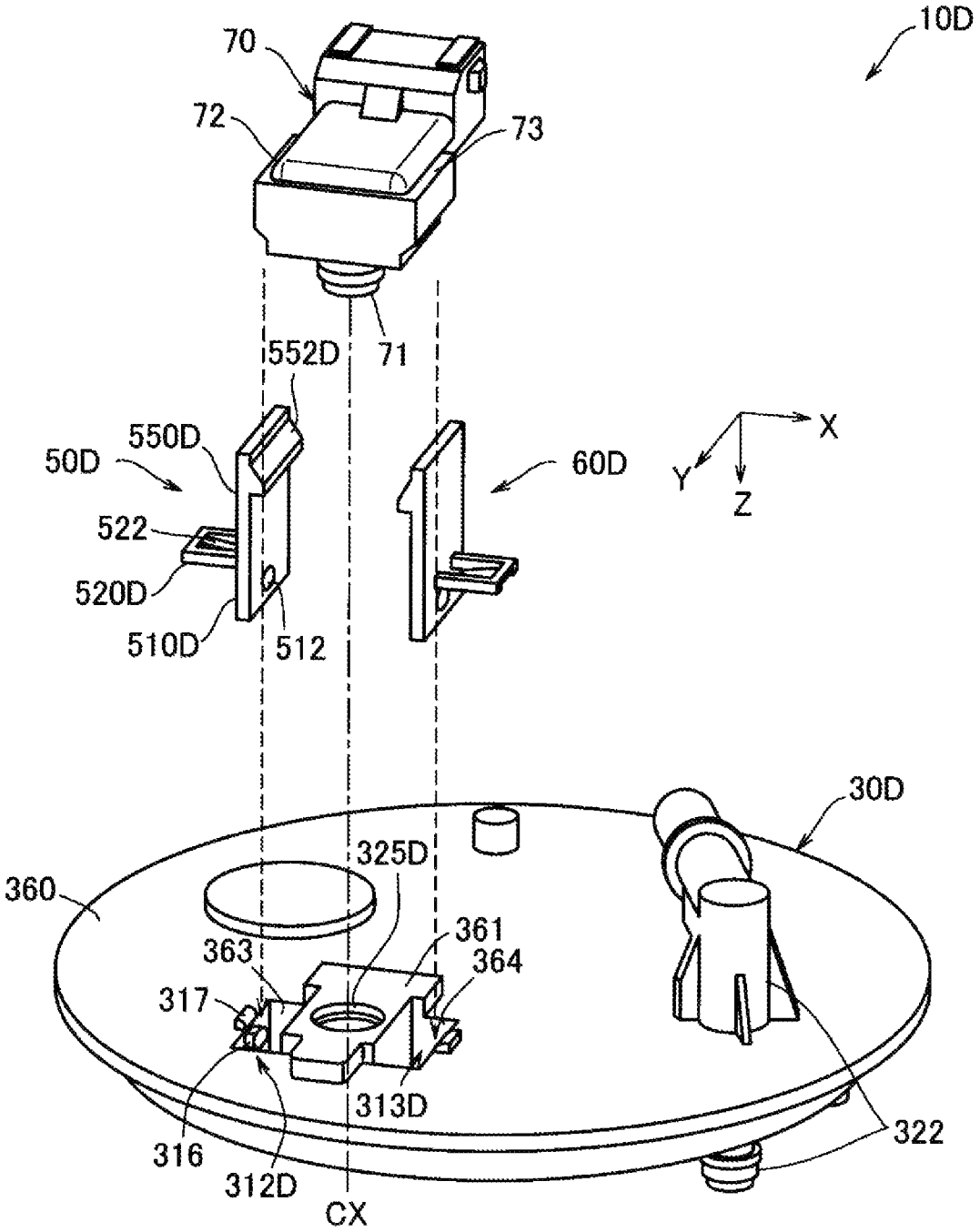
FIG. 21 is an exploded perspective view of a fuel supply device of a fourth embodiment.
Figure 22:
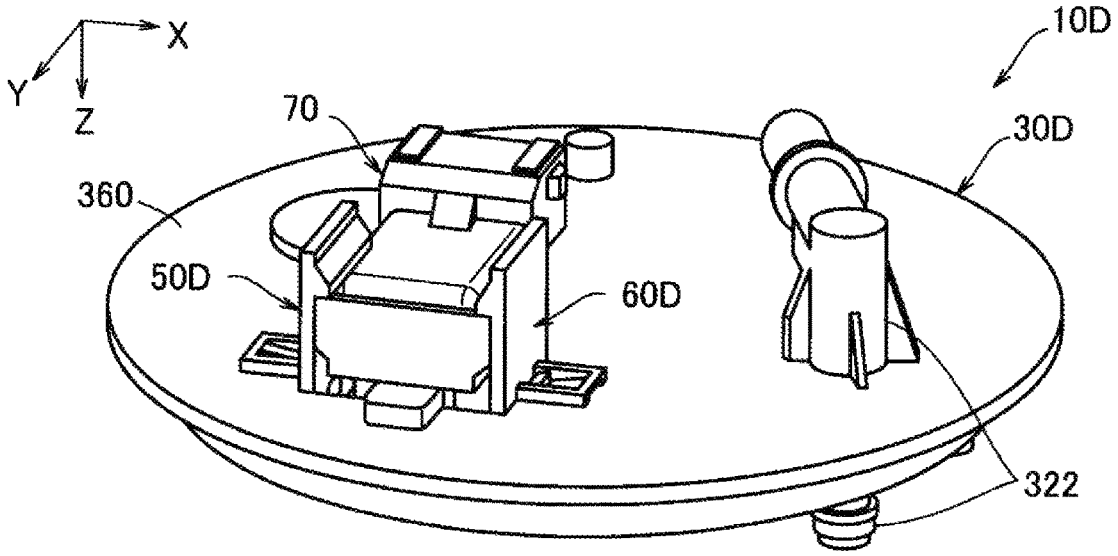
FIG. 22 is a perspective view showing a state in which a pressure sensor is mounted to the lid member using the arm member.
Figure 23:
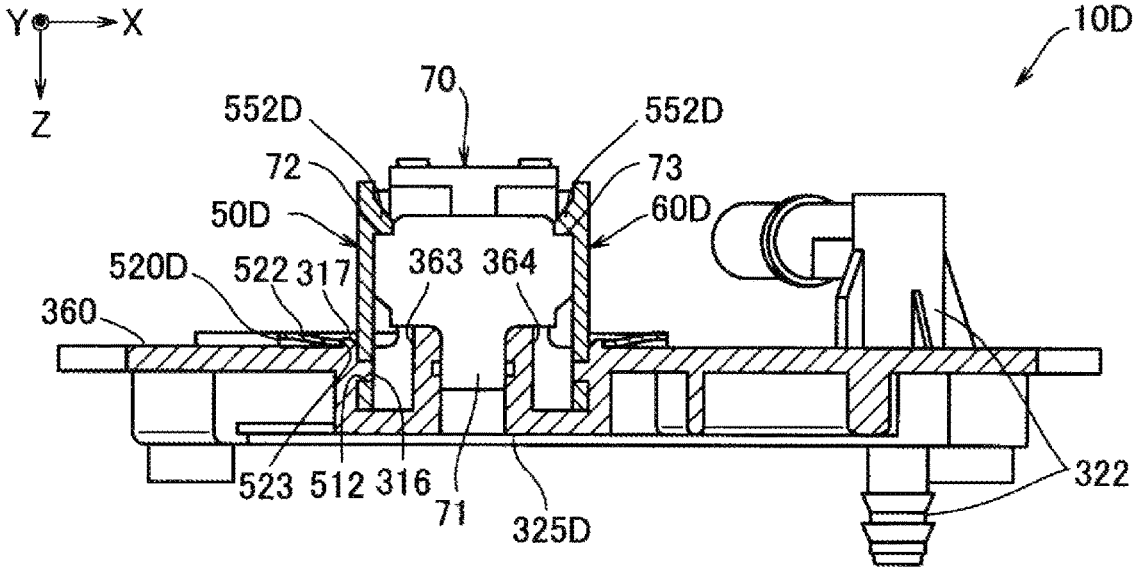
FIG. 23 is a cross-sectional view showing the arm members mounted on the lid member, and the pressure sensor mounted on the arm members.

As shown in FIG. 21, FIG. 22 and FIG. 23, in a fuel supply device 10D of the fourth embodiment, a pressure sensor 70 is mounted on an upper surface 360 of the lid member 30D on a side opposite to the opening 21 (FIG. 2) side of the fuel tank 20 (FIG. 2) via a pair of arm members 50D and 60D. Note that the same reference signs as those in the first to third embodiment indicate the same configuration, and refer to the preceding descriptions.

As shown in FIG. 23, the pressure sensor 70 detects a pressure received from a gas inside the fuel tank 20 at a detection port 71 inserted into a pressure sensor port 325D. The pressure sensor 70 is one of a plurality of components configuring the fuel supply device 10D, and is a functional component that functions to detect a pressure in the internal volume of the fuel tank.

In addition to the pressure sensor 70, various ports and various components are mounted on the lid member 30D, but in this example, they are omitted except for the fuel port 322.

As shown in FIG. 21, a pair of grooves 363 and 364 are provided on both sides of the installation base 361 of the pressure sensor 70. One groove 363 is provided with a lid member side mounting portion 312D at an upper end portion on an opposite side of the installation base 361 side. The other groove 364 is provided with a lid member side mounting portion 313D at an upper end portion on an opposite side of the installation base 361 side. One lid member side mounting portion 312D has a first convex portion 316 on a side surface of the groove 363 and a second convex portion 317 on the upper surface 360 of the lid member 30D, similarly to the lid member side mounting portion 312 (FIG. 3). The other lid member side mounting portion 313D is also the same as the lid member side mounting portion 312D. Corresponding arm members 50D and 60D are mounted on the pair of lid member side mounting portions 312D and 313D.

As shown in FIG. 21 and FIG. 23, the arm members 50D and 60D have first engaging portions 510D having the concave portions 512 into which the first convex portion 316*s* (FIG. 3) of the lid member side mounting portions 312D and 313D are fitted and second engaging portions 520D having the gaps 523 of the tabs 522 which are engaged with the second convex portions 317 (FIG. 3). The functions of the first engaging portion 510D and the second engaging portion 520D are the same as those of the first engaging portion 510 and the second engaging portion 520 (FIG. 5) of the arm members 50 and 60 of the first embodiment.

The arm members 50D and 60D have engaging arm portions 550D having engaging convex portions 552D fitted with engaging concave portions 72 and 73 as component side mounting portions of the pressure sensor 70 at an upper ends of the first engaging portion 510D and the second engaging portion 520D.

When mounting the pressure sensor 70, the detection port 71 of the sensor 70 is inserted from above the arm members 50D and 60D mounted on the pair of lid member side mounting portions 312D and 313D toward the pressure sensor port 325D of the installation base 361 in the +Z direction. At this time, the engaging arm portions 550D of the arm members 50D and 60D become a state of being expanded when the engaging convex portions 552D at the distal end come into contact with a side surface of the pressure sensor 70, and then, being freely released when the engaging convex portions 552D reaches the engaging concave portions 72 and 73 of the pressure sensor 70. As a result, as shown in FIG. 23, the engaging convex portions 552D of the arm members 50D and 60D and the engaging concave portions 72 and 73 of the pressure sensor 70 are fitted with, and the pressure sensor 70 is engaged with the arm members 50D and 60D. That is, the engaging arm portions 550D of the arm members 50D and 60D and the engaging concave portions 72 and 73 as the component side mounting portions of the pressure sensor 70 form the snap-fit structure which engages the arm members 50D and 60D and the pressure sensor 70 by the elastic deformation of the engaging arm portions 550D.

As described above, as shown in FIG. 22, the pressure sensor 70 is mounted on the lid member 30D by being engaged with the arm members 50D and 60D by the snap-fit structure formed of the engaging concave portions 72 and 73 as the pair of component side mounting portions of the pressure sensor 70 and the engaging arm portions 550D and 550D of the corresponding arm members 50D and 60D.

In the fourth embodiment, since the pair of arm members 50D and 60D are arranged on the upper surface 360 side of the lid member 30D, it is difficult to use the POM, which is the resin material having a large elastic modulus and toughness, used in the arm members 50, 50B, 60 and 60B of the first to third embodiments in view of acid resistance. Therefore, the arm members 50D and 60D are formed by injection molding or the like using, e.g., PPS containing an elastomer, PPA containing an elastomer, or the like as a resin material having acid resistance and a high elastic modulus and toughness. Since these materials have a problem that it is difficult to form a large member that requires a large amount of resin, it is difficult to use them as a material for a large member such as a lid member. However, a small member such as the arm member may solve these problems and be used.

The fuel supply device 10D of the fourth embodiment can also obtain the same effect as the fuel supply device 10 of the first embodiment. Further, since the lid member side mounting portions 312D and 313D are provided in the grooves 363 and 364 provided on the upper surface 360 of the lid member 30 and the arm members 50D and 60D are mounted, height of the components including the pressure sensor 70 can be reduced. Although water and acidic deposits are likely to accumulate in the grooves 363 and 364, since the lid member 30D is formed by using a resin material having acid resistance (PPS or the like), there is no risk of acid deterioration even if the groove is provided in the lid member.

G: Other Embodiments (i) As shown in FIG. 1 and FIG. 2, the first embodiment describes the configuration, as an example, in which the on-off valve 40 is mounted to the lid member 30 via the pair of arm members 50 and 60 arranged to face each other. However, the present disclosure is not limited to this, and the component may be mounted to the lid member via one arm member, or the component may be mounted to the lid member via three or more arm members. The same applies to the second to fourth embodiments.

(ii) As shown in FIG. 1 and FIG. 2, in the first embodiment, the first convex portions 316 of the lid member side mounting portions 312 and 313, which is fitted with the concave portions 512 of the arm members 50 and 60, are arranged on positions located on a side in the +Z direction than the lower surface 321 of the component flange portion 320 located outside thereof in the valve mounting portion 310 where the on-off valve 40 as a component is arranged. However, the present disclosure is not limited to this, and the lid member side mounting portions 312 and 313 may be provided on the lower surface 321 of the component flange portion 320.

(iii) The first embodiment describes the configuration, as an example, in which the lid member 30 is provided with a single pair of lid member side mounting portions 312 and 313 corresponding to a single pair of arm members 50 and 60. Alternatively, a plurality of pairs of lid member side mounting portions may be provided with respect to a single pair of arm members 50 and 60. In this way, it is possible to increase the degree of freedom in arranging the arm members for mounting the component. The same applies to the second to fourth embodiments.

(iv) The first embodiment describes the configuration (FIG. 6), as an example, in which the first convex portions 316 as the first engaging portions and the concave portions 512 as the first engaged portions, and the second engaging portion 520 having the second convex portions 317 as the second engaging portions and the gaps 523 of the tabs 522 as the second engaged portions, in the arm members 50 and 60 and the lid member side mounting portions 312 and 313. However, the present invention is not limited to this, and a configuration in which the second engaging portion and the second engaged portion are omitted is also possible. The same applies to the second to fourth embodiments.

(v) The first embodiment describes the configuration, as an example, in which the concave portions 512 provided in the first engaging portions 510 of the arm members 50 and 60 are through holes. Alternatively, it may be grooves instead of the through holes. The same applies to the second to fourth embodiments.

(vi) The structure of the engaging arm portions 550B and the component side mounting portions 420B of the second embodiment may employ the structure of the engaging arm portions 550 and the component side mounting portions 420 of the first embodiment, and the structure of the engaging arm portions 550 and the component side mounting portions 420 of the first embodiment may employ the structure of the engaging arm portions 550B and the component side mounting portions 420B of the second embodiment. Further, the structure of the engaging arm portion 550D and the engaging concave portions 72 and 73 as the component side mounting portions of the third embodiment may employ the structure of the engaging arm portion 550B and the component side mounting portion 420B of the second embodiment. That is, the structure of the engaging arm portion of the arm member and the component side mounting portion may be any structure as long as it has an engaging structure, e.g., the snap-fit structure which engages each other by elastic deformation of the arm member.

(vii) The first engaging portions 510D and the second engaging portions 520D of the arm members 50D and 60D of the fourth embodiment are the same configuration as the first engaging portions 510 and the second engaging portions 520 of the arm members 50 and 60 of the first embodiment, but may be the same configuration as the first engaging portions 5108 and the second engaging portions 520B of the second embodiment. Further, the structure of the first convex portion 316 of the lid member side mounting portions 312D and 313D of the fourth embodiment may employ the same structure of the first convex portion 316C of the third embodiment.

(viii) The above embodiments describe the on-off valve or the pressure sensor as examples of components mounted on the lid member via the arm member, but the present invention is not limited to these and may be used for various components used in the fuel supply device.

F. Reference Embodiment

The above embodiment describes the cases in which the component used for the fuel supply device is mounted on the lid member having acid resistance via the arm member having a high elastic modulus and toughness by the snap-fit structure formed on the arm member and the component. Contrary, a following shows a reference embodiment which enables components to be mounted on the arm member integrally formed with the lid member made of the acid resistant resin material by the snap-fit structure.

Figure 24:
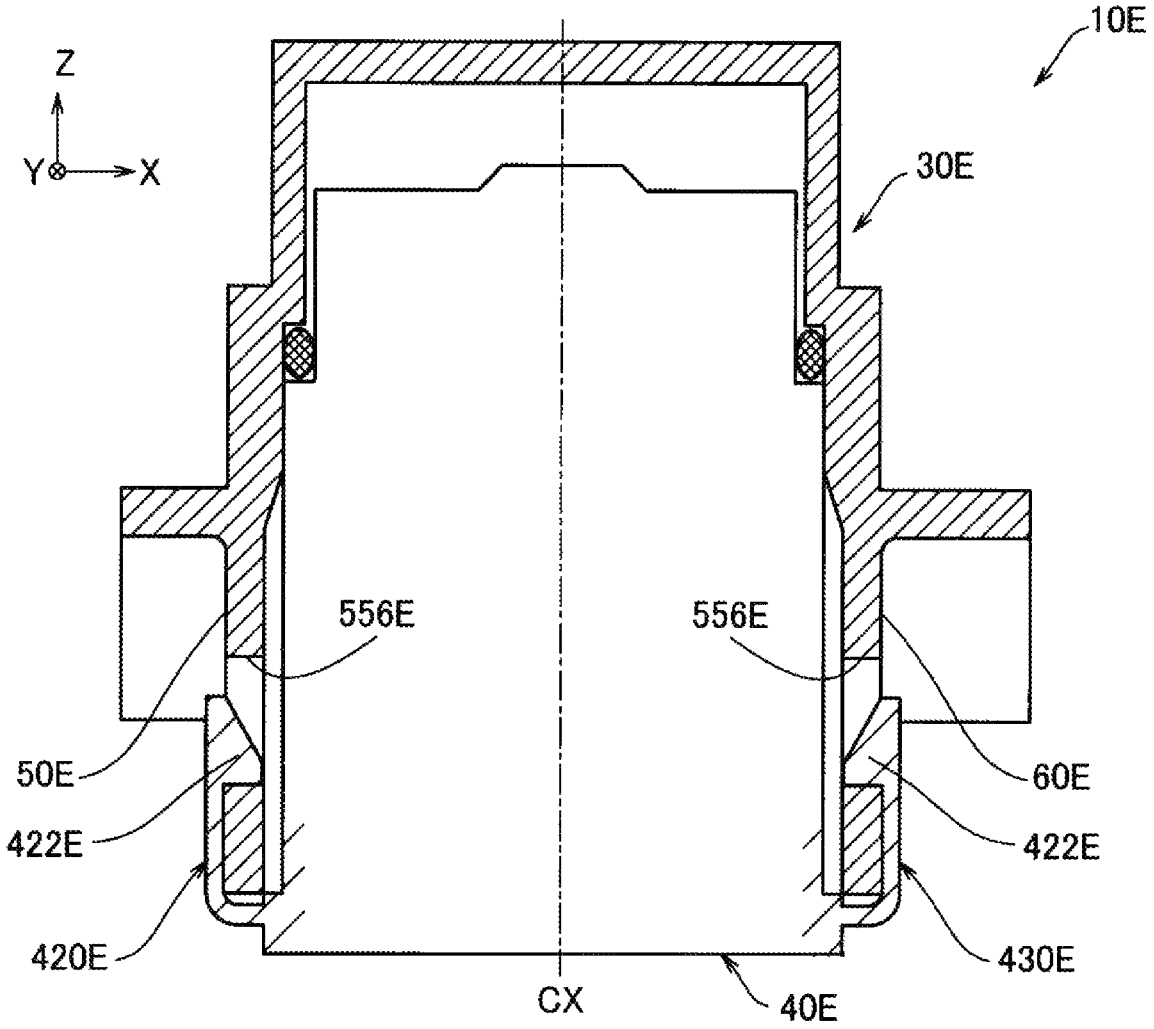
FIG. 24 is a cross-sectional view showing a fuel supply device of a reference embodiment.

The fuel supply device 10E shown in FIG. 24 has a configuration in which the lid member 30E and the arm members 50E and 60E are integrally formed by using a resin material (PPS, PPA, etc.) having acid resistance but low toughness. Further, the fuel supply device 10E has a configuration in which the on-off valve 40E is provided with arm-shaped component side mounting portions 420E and 430E having engaging convex portions 422E that is fitted with the engaging concave portions 556B of the arm members 50E and 60E. The component side mounting portions 420E and 430E are provided integrally or separately on the outer surface of the on-off valve 40E by using an elastically deformable resin material. The engaging concave portions 556E of the arm members 50E and 60E and the component side mounting portions 420E and 430E of the on-off valve 40E form the snap-fit structures. In the fuel supply device 10E, the on-off valve 40E can be mounted on the lid member 30E by the snap-fit structure.

Figure 25:
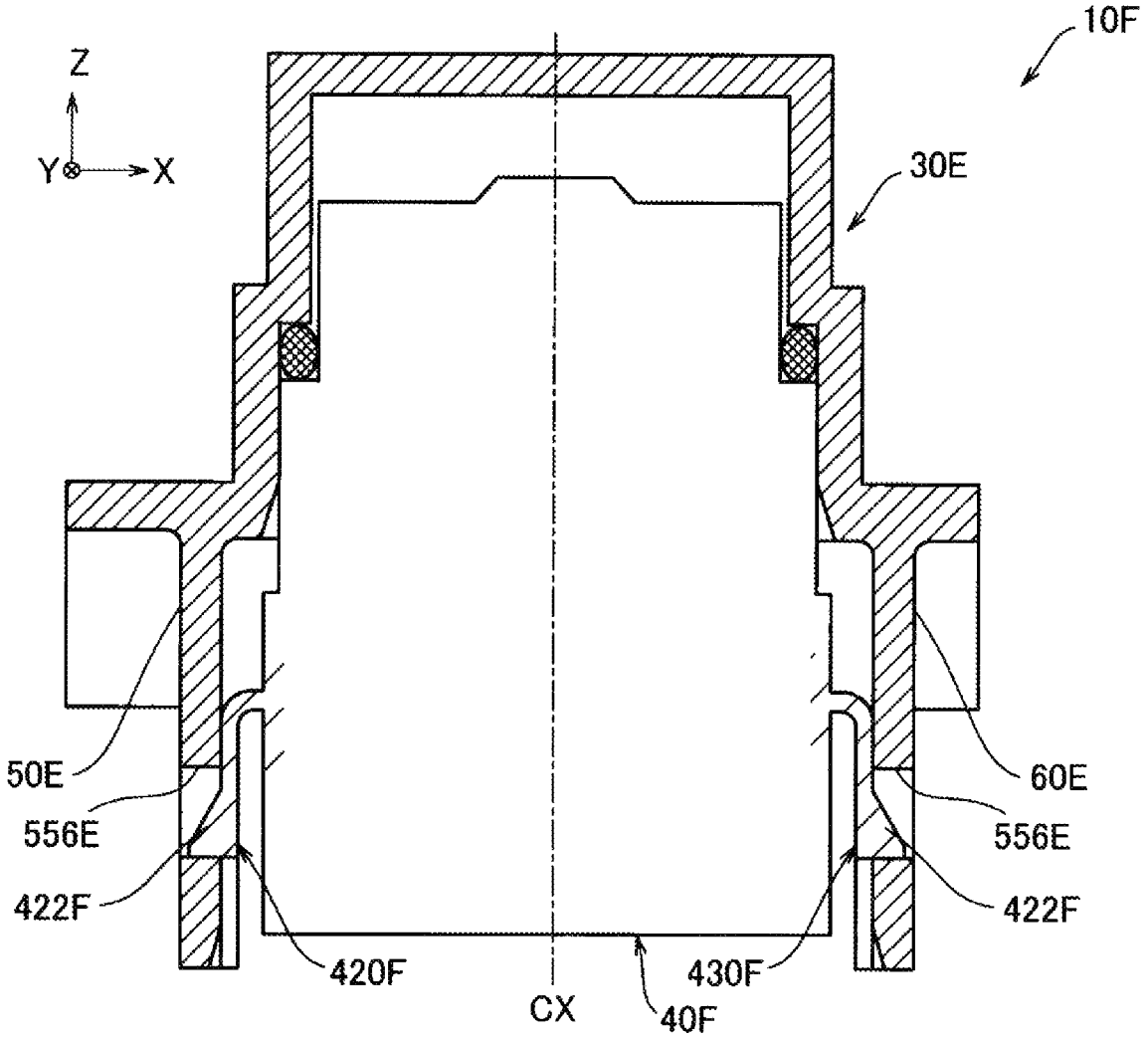
FIG. 25 is a cross-sectional view showing a fuel supply device of another reference embodiment.

The fuel supply device 10F shown in FIG. 25 is the same as the fuel supply device 10E in FIG. 24, except that shapes of arms of the component side mounting portions 420F and 430F provided on the on-off valve 40F which are designed to shapes adapted to an engaging method different from an engaging method of the component side mounting portions 420E and 430E of the on-off valve 40E to the engaging concave portions 556E of the arm members 50E and 60E. The engaging concave portions 556E of the arm members 50E and 60E and the component side mounting portions 420F and 430F of the on-off valve 40F form snap fit structures. In the fuel supply device 10F, the on-off valve 40F can be mounted on the lid member 30E by the snap-fit structure.

The present disclosure should not be limited to the embodiments described above, and various other embodiments may be implemented without departing from the scope of the present disclosure. For example, in order to solve some or all of the above problems, or to achieve some or all of the above effects, the technical features in the embodiments can be replaced or combined as appropriate. Also, if the technical features are not described as essential in the present specification, they can be deleted as appropriate.

What is claimed is:

1. A fuel supply device mounted on a fuel tank, the device comprising:

a lid member covering an opening of the fuel tank, an arm member mounted on the lid member, and a component mounted on the lid member via the arm member, wherein the arm member and the component have an engaging structure which engages each other by elastic deformation of the arm member, the arm member is made of a resin material having a higher elastic modulus than the resin material forming the lid member, the lid member has a surface which comes into contact with the arm member along a first direction in which the component is assembled, the surface is provided with and has a first engaging portion for engaging with the arm member, the arm member has a first engaged portion corresponding to the first engaging portion, the fuel supply device further comprises more than one additional arm member, and the lid member has a number of the first engaging portions that is larger than a number of the arm members.

2. A fuel supply device mounted on a fuel tank, the device comprising:

a lid member covering an opening of the fuel tank, an arm member mounted on the lid member, and a component mounted on the lid member via the arm member, wherein the arm member and the component have an engaging structure which engages each other by elastic deformation of the arm member, the arm member is made of a resin material having a higher elastic modulus than the resin material forming the lid member, the lid member has a surface which comes into contact with the arm member along a first direction in which the component is assembled, the surface is provided with and has a first engaging portion for engaging with the arm member, the arm member has a first engaged portion corresponding to the first engaging portion, the first engaging portion has a convex portion projecting in a second direction which is orthogonal to the first direction and is directed towards a side to the arm member, and the first engaged portion has a concave portion into which the convex portion is fitted.

3. The fuel supply device claimed in claim 2, wherein the convex portion has a tapered shape having a protruding amount which increases towards the first direction.

4. The fuel supply device claimed in claim 2, wherein the concave portion is a through hole, and wherein a gap between the convex portion and the component is smaller than a thickness of the arm member in a state where the component is mounted on the lid member via the arm member.

5. A fuel supply device mounted on a fuel tank, the device comprising:

a lid member covering an opening of the fuel tank, an arm member mounted on the lid member, and a component mounted on the lid member via the arm member, wherein the arm member and the component have an engaging structure which engages each other by elastic deformation of the arm member, the arm member is made of a resin material having a higher elastic modulus that the resin material forming the lid member, the lid member has a surface which comes into contact with the arm member along a first direction in which the component is assembled, the surface is provided with and has a first engaging portion for engaging with the arm member, the arm member has a first engaged portion corresponding to the first engaging portion, the lid member and the arm member have a second engaging portion, on a surface of the lid member, to engage the arm member and the lid member and a second engaged portion, on a surface on the arm member, engaged with the second engaging portion, and wherein the surfaces come into contact with each other along a direction different from surfaces arranged with the first engaging portion and the first engaged portion.

6. The fuel supply device claimed in claim 5, wherein either one pair of a pair of the first engaging portion and the first engaged portion and a pair of the second engaging portion and the second engaged portion is able to be engaged by elastically deforming the arm member.

* * * * *